US009133801B2

(12) United States Patent
Morris et al.

(10) Patent No.: US 9,133,801 B2
(45) Date of Patent: Sep. 15, 2015

(54) FUEL INJECTOR WITH INJECTION CONTROL VALVE SPRING PRELOAD ADJUSTMENT DEVICE

(71) Applicant: CUMMINS INC., Columbus, IN (US)

(72) Inventors: Corydon E. Morris, Columbus, IN (US); David M. Rix, Columbus, IN (US)

(73) Assignee: CUMMINS INC., Columbus, IN (US)

( * ) Notice: Subject to any disclaimer, the term of this patent is extended or adjusted under 35 U.S.C. 154(b) by 495 days.

(21) Appl. No.: 13/666,833

(22) Filed: Nov. 1, 2012

(65) Prior Publication Data

US 2013/0119166 A1 May 16, 2013

Related U.S. Application Data

(60) Provisional application No. 61/554,117, filed on Nov. 1, 2011.

(51) Int. Cl.

| | |
|---|---|
| ***F02M 59/20*** | (2006.01) |
| ***F02M 61/16*** | (2006.01) |
| ***F02M 63/00*** | (2006.01) |
| ***F02M 63/02*** | (2006.01) |
| ***F02M 55/00*** | (2006.01) |
| ***F02M 51/06*** | (2006.01) |

(52) U.S. Cl.

CPC ..... *F02M 61/161* (2013.01); *F02M 51/061* (2013.01); *F02M 55/002* (2013.01); *F02M 63/0056* (2013.01); *F02M 63/0215* (2013.01); *F02M 63/0225* (2013.01)

(58) Field of Classification Search

CPC ..... F02M 63/0225; F02M 63/0056; F02M 55/002; F02M 51/061; F02M 61/161; F02M 61/205

USPC ..... 239/533.6, 585.1, 585.2, 585.5; 251/129.18; 137/315.03

See application file for complete search history.

(56) References Cited

U.S. PATENT DOCUMENTS

| | | | | |
|---|---|---|---|---|
| 3,288,190 | A | | 11/1966 | Holmes |
| 3,346,188 | A | * | 10/1967 | Nusbaum ..... 239/90 |
| 3,373,943 | A | * | 3/1968 | Roosa ..... 239/533.6 |
| 3,451,626 | A | * | 6/1969 | Roosa ..... 239/533.11 |
| 4,071,067 | A | | 1/1978 | Goldby |
| 4,076,064 | A | | 2/1978 | Holmes |
| 4,258,607 | A | | 3/1981 | McKewan |
| RE31,284 | E | | 6/1983 | Holmes |
| 4,485,969 | A | | 12/1984 | Deckard et al. |
| 4,661,031 | A | | 4/1987 | Heine |
| 4,911,127 | A | | 3/1990 | Perr |
| 5,169,270 | A | | 12/1992 | Erickson |
| 5,209,403 | A | | 5/1993 | Tarr et al. |

(Continued)

FOREIGN PATENT DOCUMENTS

| | | |
|---|---|---|
| EP | 1 705 365 B1 | 9/2006 |
| GB | 2 104 158 A | 3/1983 |
| GB | 2 351 773 A | 1/2001 |

*Primary Examiner* — Dinh Q Nguyen

(74) *Attorney, Agent, or Firm* — Faegre Baker Daniels LLP

(57) ABSTRACT

A fuel injector including an injection control device valve spring preload adjustment device is disclosed. The fuel injector includes a transverse access passage extending at an acute angle to a longitudinal axis of the fuel injector. The preload adjustment device includes at least one transverse slot that creates a cantilevered thread portion. The cantilevered thread portion is deformed at a deformation angle to a plane perpendicular to the longitudinal axis to form a locking feature.

17 Claims, 6 Drawing Sheets

(56) References Cited

U.S. PATENT DOCUMENTS

| | | | |
|---|---|---|---|
| 5,301,875 | A | 4/1994 | Gant et al. |
| 5,501,197 | A | 3/1996 | Smith |
| 5,542,799 | A | 8/1996 | Culpen |
| 5,694,903 | A | 12/1997 | Ganser |
| 5,720,318 | A | 2/1998 | Nagarajan et al. |
| 5,819,704 | A | 10/1998 | Tarr et al. |
| 5,820,033 | A | 10/1998 | Cooke |
| 5,904,300 | A | 5/1999 | Augustin |
| 5,979,789 | A | 11/1999 | Sullivan et al. |
| 6,056,264 | A | 5/2000 | Benson et al. |
| 6,155,503 | A | 12/2000 | Benson et al. |
| 6,286,768 | B1 | 9/2001 | Vetters et al. |
| 6,298,826 | B1 | 10/2001 | Cotton, III |
| 6,378,497 | B1 | 4/2002 | Keyster et al. |
| 6,439,202 | B1 | 8/2002 | Carroll, III et al. |
| 6,655,602 | B2 | 12/2003 | Shafer et al. |
| 6,655,610 | B2 | 12/2003 | Bulgatz et al. |
| 6,840,268 | B2 | 1/2005 | Kennedy et al. |
| 6,840,500 | B2 | 1/2005 | Dallmeyer et al. |
| 6,997,165 | B2 | 2/2006 | Stockner et al. |
| 7,025,045 | B2 | 4/2006 | Hlousek |
| 7,156,368 | B2 | 1/2007 | Lucas et al. |
| 7,159,800 | B2 | 1/2007 | Peterson, Jr. |
| 7,309,033 | B2 | 12/2007 | Dallmeyer |
| 7,347,383 | B2 | 3/2008 | Dallmeyer et al. |
| 7,428,893 | B2 | 9/2008 | Shinogle et al. |
| 7,458,529 | B2 | 12/2008 | Ricco et al. |
| 7,658,179 | B2 | 2/2010 | Bock et al. |
| 7,661,410 | B1 | 2/2010 | Fuelberth et al. |
| 7,954,787 | B2 | 6/2011 | Ricco et al. |
| 8,172,161 | B2 | 5/2012 | Biagetti |
| 2009/0212134 | A1 | 8/2009 | Drake et al. |
| 2009/0236441 | A1 | 9/2009 | Hess et al. |
| 2009/0267008 | A1 | 10/2009 | Lucas et al. |
| 2010/0012753 | A1 | 1/2010 | Corbinelli et al. |

* cited by examiner

FUEL INJECTOR WITH INJECTION CONTROL VALVE SPRING PRELOAD ADJUSTMENT DEVICE

CROSS-REFERENCE TO RELATED APPLICATIONS

This application claims the benefit of priority to U.S. Provisional Patent Application No. 61/554,117, filed on Nov. 1, 2011, which is hereby incorporated by reference in its entirety.

TECHNICAL FIELD

This disclosure relates to fuel injector control valves and mechanisms to adjust a spring preload in such control valves.

BACKGROUND

Fuel injector control valves are the mechanism by which fuel injectors operate to provide a flow of fuel to a combustion chamber of an internal combustion engine. Most internal combustion engines have a plurality of fuel injectors and each fuel injector includes an injector control valve to determine the length of a fuel injection event as well as the flow rate of a fuel injection event. Best operation of the engine is attained when the force exerted by each combustion chamber on an associated piston of the combustion chamber is approximately equal. Additionally, with similar levels of fueling between combustion chambers, an engine is better able to control emissions exhausted by each combustion chamber. Because the components of injector control valves have physical variations from each other, each valve may require adjustment to achieve the proper level of fueling. Such adjustment is frequently accomplished by adjusting the force or preload on a spring positioned within the injection control valve.

SUMMARY

This disclosure provides a fuel injector for injecting fuel at high pressure into a combustion chamber of an internal engine, comprising an injector body, an injection control valve assembly, and an access passage. The injector body includes a longitudinal axis, a barrel portion, a nozzle housing, a side surface, a fuel delivery circuit, and an injector orifice formed in the nozzle housing to discharge fuel from the fuel delivery circuit into the combustion chamber. The injection control valve assembly is positioned along the longitudinal axis between the barrel portion and the nozzle housing. The injection control valve assembly includes a control valve member adapted to move between a first position and a second position, and an actuator adapted to cause movement of the control valve member between the first and the second positions. The actuator includes a bias spring positioned to apply a bias force to the control valve member and a spring preload adjustment device positioned adjacent one end of the bias spring to apply a preload force to the bias spring. The spring preload adjustment device includes a proximal end face extending transversely to the longitudinal axis and a tool engagement feature formed in the proximal end face. The access passage is formed in the barrel portion and extends transversely to the longitudinal axis. The access passage includes a proximal end opening at the side surface of the injector body and a distal end opening positioned adjacent the tool engagement feature at the proximal end face of the spring preload adjustment device. The access passage is sized and positioned to receive a tool to engage the spring preload adjustment device to adjust the preload force on the bias spring.

This disclosure also provides a fuel injector for injecting fuel at high pressure into a combustion chamber on an internal combustion engine, comprising an injector body and an injection control valve assembly. The injector body includes a longitudinal axis, a proximal end, a distal end, an outer annular side surface, an outer housing, an accumulator, a fuel delivery circuit, and an injector orifice positioned at the distal end to discharge fuel from the fuel delivery circuit into the combustion chamber. The injection control valve assembly is positioned along the longitudinal axis between the proximal end and the distal end. The injection control valve assembly includes a control valve member adapted to move between a first position and a second position, and an actuator adapted to cause movement of the control valve member between the first and the second positions. The actuator includes a bias spring positioned to apply a bias force to the control valve member, and a spring preload adjustment device positioned adjacent one end of the bias spring to apply a preload to the bias spring. The spring preload adjustment device includes at least one slot extending along a plane transversely to the longitudinal axis through the external threads to form a first set of threads and a first cantilevered portion having a second set of threads. The first cantilevered portion is deformed to extend along a first deformation angle from a plane perpendicular to the longitudinal axis.

Advantages and features of the embodiments of this disclosure will become more apparent from the following detailed description of exemplary embodiments when viewed in conjunction with the accompanying drawings.

DETAILED DESCRIPTION

Figure 1:
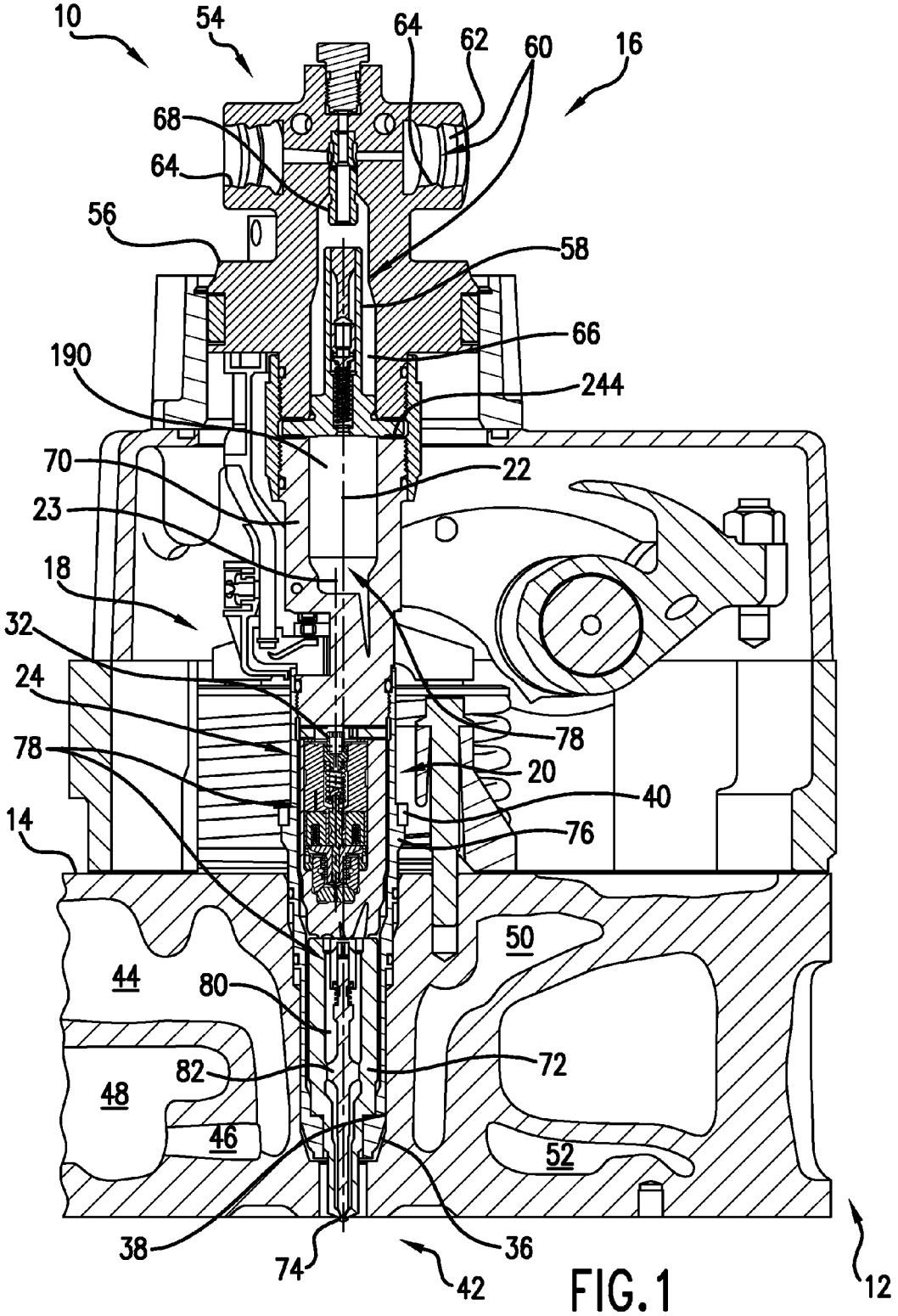
FIG. 1 is a cross-sectional view of a portion of an internal combustion engine.

Referring to FIG. 1, a portion of an internal combustion engine is shown generally indicated at 10. Engine 10 includes an engine body 12, which includes an engine block (not shown) and a cylinder head 14 attached to the engine block. Engine 10 also includes a fuel system 16 that includes one or more fuel injectors 18, a fuel pump, a fuel accumulator, valves, and other elements (not shown) that connect to fuel injector 18.

Figure 2:
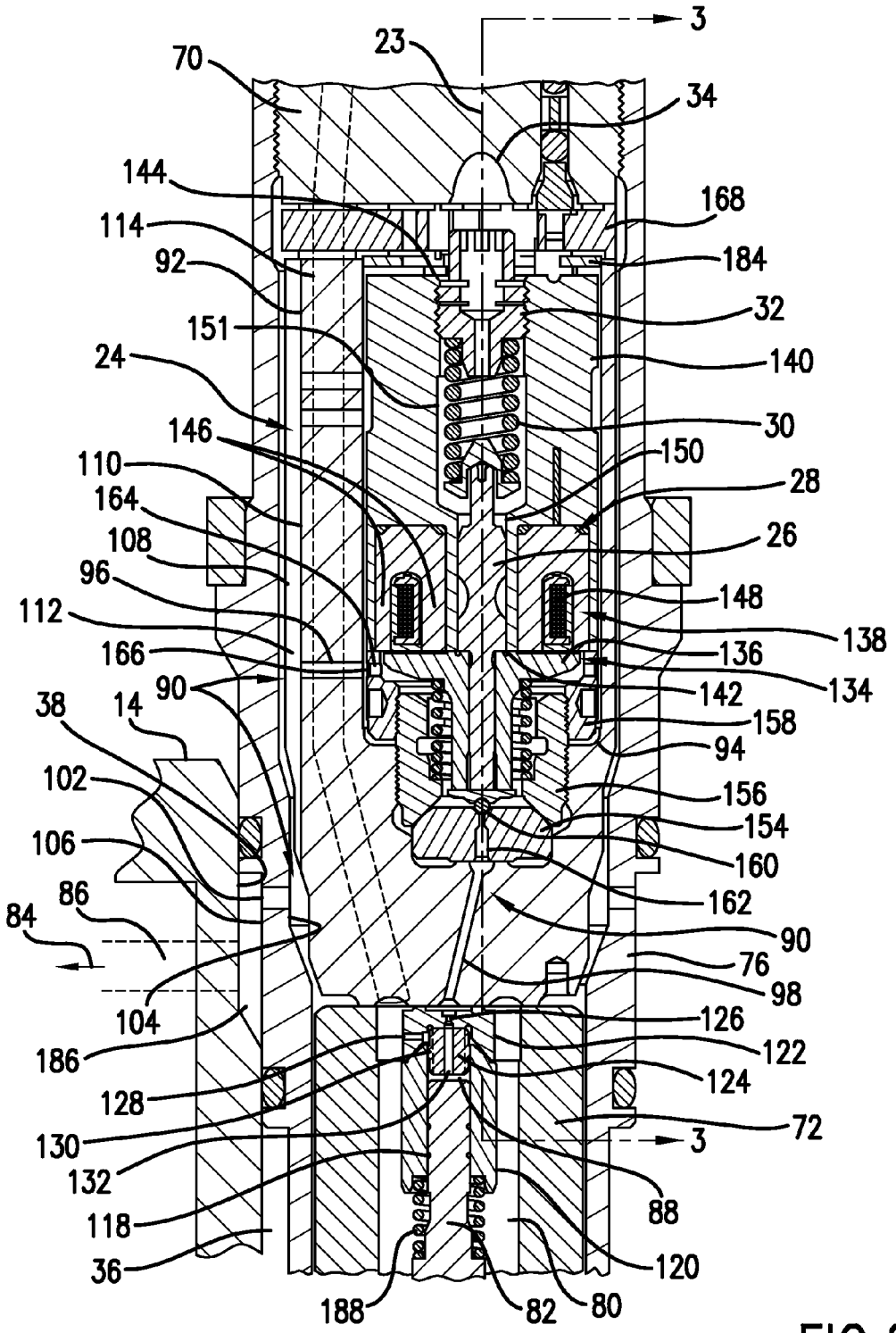
FIG. 2 is a cross-sectional view of a portion of a fuel injector of the internal combustion engine of FIG. 1 incorporating an exemplary embodiment of the present disclosure.
Figure 8:
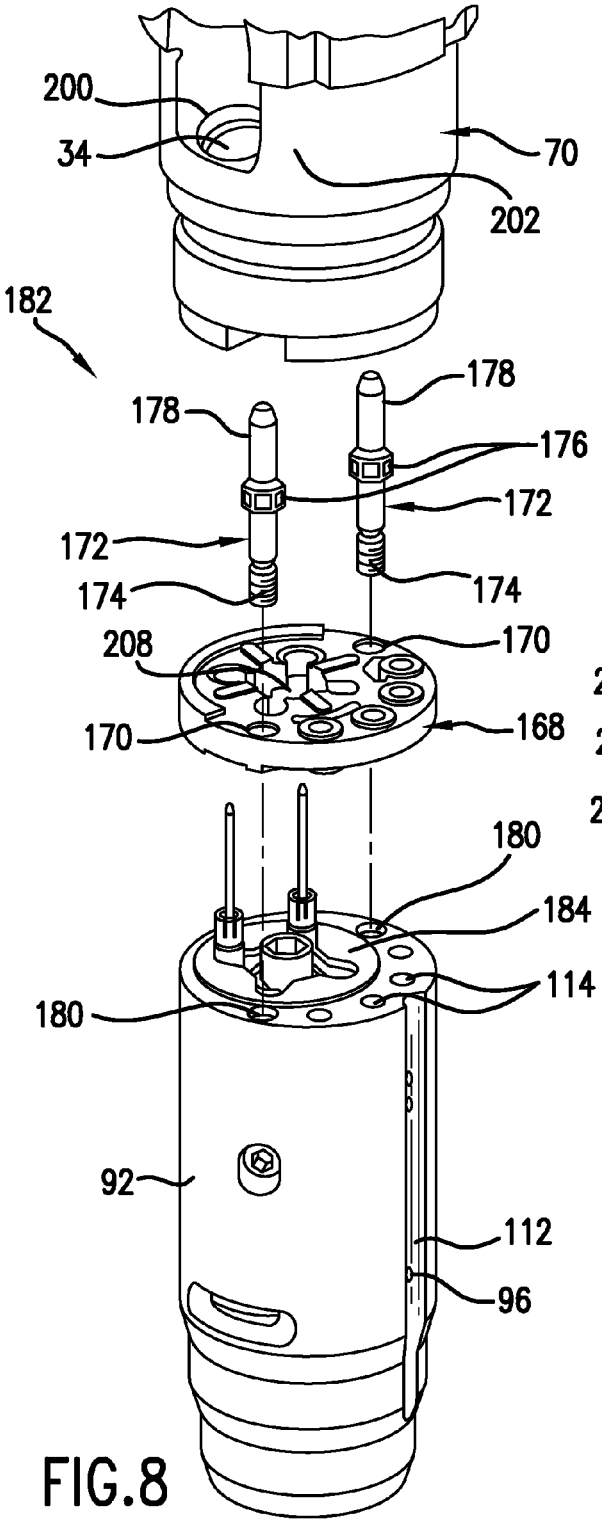
FIG. 8 is a perspective exploded view of certain components of the fuel injector of FIGS. 2 and 3.

Referring to FIGS. 1, 2 and 8, fuel injector 18 includes an injector body 20 including a longitudinal axis 22, an injection control valve assembly 24, a nozzle valve element 80, a control volume 88 and a drain circuit 90. Injection control valve assembly 24 includes a control valve member 26 having a longitudinal axis 23, an actuator 28, and a valve housing 92 having a valve cavity 94 formed therein. Control valve longitudinal axis 23 is parallel to and spaced a transverse distance from fuel injector longitudinal axis 22. Actuator 28 includes a valve bias spring 30 and a spring preload adjustment device 32 positioned longitudinally adjacent to one end of valve bias spring 30 along control valve longitudinal axis 23 to provide a preload force to valve bias spring 30. Injector body 20 also includes an access passage 34 that extends at an acute angle to control valve longitudinal axis 23 and is sized and positioned to receive an adjustment tool that engages preload adjustment device 32. Access passage 34 is oriented in a manner that permits access passage 34 to be positioned in one portion of injector body 20, leaving the other portions, such as an accumulator and an outer housing or retainer, unaffected. The acute angle of access passage 34 is such that the adjustment tool may engage preload adjustment device 32 and modify the preload of valve bias spring 30 between a minimum preload position and a maximum preload position while the tool remains engaged to preload adjustment device 32 and after fuel injector 18 has been completely assembled.

Engine body 12 includes a mounting bore 36, formed by an inner wall or surface 38 and sized to receive fuel injector 18, and a clamp assembly 40 for securing fuel injector 18 in mounting bore 36. Engine body 12 also includes a combustion chamber 42 and one or more coolant passages 44, 46, 48, 50, and 52 arranged about mounting bore 36 and along combustion chamber 42 to provide cooling to fuel injector 18 and components surrounding or adjacent combustion chamber 42. Engine body 12 further includes a low-pressure engine drain circuit 84 including an engine drain passage 86 connected to a low-pressure drain, e.g., an engine fuel sump. Combustion chamber 42, only a portion of which is shown in FIG. 1, is positioned in a known manner in engine body 12, between cylinder head 14 and the engine block (not shown). At least a portion of at least one coolant passage, e.g., coolant passages 44 and 50, extends in a longitudinal direction in a portion of cylinder head 14 alongside or adjacent mounting bore 36. At least a portion of at least one coolant passage, e.g., coolant passages 46 and 52, extend generally transverse to mounting bore 36 in a portion of cylinder head 14 that is at least partially alongside combustion chamber 42.

A flow limiter assembly 54 may be positioned at a proximate end of fuel injector 18. Flow limiter assembly 54 may include a limiter outer housing 56, a flow limiter sub-assembly 58, and an inlet fuel circuit 60. Inlet fuel circuit 60 extends along limiter outer housing 56, is positioned to connect to fuel system 16, and receives fuel from fuel system 16 for delivery to fuel injector 18. Limiter outer housing 56 includes a high-pressure inlet 62, one or more bosses 64, and a housing recess or bore portion 66 into which a portion of flow limiter sub-assembly 58 extends. High-pressure inlet 62 may be connected to a fuel rail or accumulator (not shown), or may be a part of a daisy chain arrangement wherein other fuel injectors may be connected via appropriate high-pressure lines to, for example, bosses 64 integrally formed in limiter outer housing 56, either upstream or downstream of high-pressure inlet 62. Inlet fuel circuit 60 extends from high-pressure inlet 62 through limiter outer housing 56 and through flow limiter sub-assembly 58. Flow limiter assembly 54 may include a pulsation dampener 68 positioned along inlet fuel circuit 60, which serves to reduce transmission of pulsation waves, caused by injection events, between fuel injectors.

In addition to longitudinal axis 22 and control valve assembly 24, injector body 20 includes an upper body or barrel portion 70, a nozzle housing 72, a retainer or outer housing 76, a fuel delivery circuit 78, and a nozzle valve element 82. Nozzle housing 72 includes injector cavity 80 and one or more injector orifices 74 formed at a near, inward or distal end of nozzle housing 72, which is also the distal end of injector body 20. Injector cavity 80 is sized to receive nozzle valve element 82 for reciprocal motion therein. Injector orifices 74 communicate with one end of injector cavity 80 to discharge or inject high-pressure fuel from fuel delivery circuit 78 into combustion chamber 42. Nozzle valve element 82 is positioned in injector cavity 80 with a distal end adjacent injector orifice 74. Nozzle valve element 82 is movable between an open position in which fuel may flow through injector orifice 74 into combustion chamber 42 and a closed position in which fuel flow through injector orifice 74 is blocked. Outer housing 76 includes a valve housing interior surface 104, an outer housing exterior surface 106, and an outlet port 102 extending from valve housing interior surface 104 to outer housing exterior surface 106. An axially inwardly extending drain passage 186 is formed between outer housing exterior surface 106 and inner wall 38 of mounting bore 36. Axially inwardly extending drain passage 186 is positioned to receive drain fuel from outlet port 51 and to connect that drain fuel to engine drain passage 86.

Nozzle valve element 82 extends into a nozzle element cavity 118 formed within a nozzle element guide 120. Control volume 88 is formed between an end of nozzle valve element 82 and an interior of nozzle element guide 120. Nozzle element guide 120 includes a proximal cap or end portion 122 and a control volume plug 124. End portion 122 of nozzle element guide 120 forms control volume 88 when end portion 122 and nozzle element guide 120 are mounted in injector cavity 80. Control volume plug 124 is mounted within nozzle element cavity 118 in a location adjacent to end portion 122. End portion 122 includes an end portion passage 126 that extends longitudinally through end portion 122 and one or more transverse end portion passages 128. Control volume plug 124 includes a plurality of longitudinal plug channels or passages 130 located about a periphery of control volume plug 124 and a longitudinally extending central passage 132. Control volume 88 receives high-pressure fuel from injector cavity 80 by way of transverse end portion passage 128 and plug passage 130. Central passage 132 is positioned to connect control volume 88 to end portion passage 126.

The pressure of fuel in control volume 88 determines whether nozzle valve element 82 is in an open position or a closed position, which is further determined by injection control valve assembly 24, described in more detail hereinbelow. When nozzle valve element 82 is positioned in injector cavity 80, nozzle element guide 120, and more specifically, end portion 122 of nozzle element guide 120, is positioned longitudinally or axially between nozzle valve element 82 and injection control valve assembly 24. Other servo controlled nozzle valve assemblies may be used, such as those disclosed in U.S. Pat. No. 6,293,254, the entire content of which is hereby incorporated by reference.

Fuel delivery circuit 78 is positioned to connect high-pressure fuel from inlet fuel circuit 60 to injector cavity 80 and control volume 88. Fuel delivery circuit 78 includes a plurality of longitudinally or axially extending fuel delivery passages 114 extending through injection control valve assembly 24 to provide high-pressure fuel to injector cavity 80 and control volume 88. Injection control valve assembly 24 is positioned along longitudinal axis 22 between barrel portion 70 and nozzle housing 72 and along drain circuit 90, and further includes a fuel injector control valve 134 positioned within valve cavity 94. Injector control valve 134 includes control valve member 26 and actuator 28 positioned in valve housing 92 to cause movement of control valve member 26 between a first, closed position and a second, open position. Control valve member 26 is positioned in valve cavity 94 to move reciprocally between the second, open position permitting flow through drain circuit 90 and the first, closed position blocking flow through drain circuit 90. Valve bias spring 30 applies a biasing force to control valve member 26 to bias control valve member 26 toward the first, closed position.

Actuator 28 includes a solenoid assembly 138 that includes a stator housing 140 having a first end 142 and a second end 144, a stator 146 positioned in stator housing 140, a coil 148 positioned circumferentially in and around stator 146, and an armature 136 operably connected to control valve member 26. Stator housing 140 includes a central aperture, bore or core 150 extending through stator housing 140 from first end 142 to second end 144. Central aperture 150 is positioned to receive control valve member 26. Central aperture 150 includes a spring bore portion 151 in which valve bias spring 30 is positioned. Spring bore portion 151 includes an internal thread 214 for engaging with threads formed on an exterior of spring preload adjustment device 32.

Valve housing 92 further includes one or more axially extending fuel delivery passage(s) 114, which are part of fuel delivery circuit 78, a transversely or radially extending passage 96, and a first drain passage 98. A longitudinally or axially inwardly extending flow passage 108 is provided to connect transversely extending passage 96 to outlet port 102. Inward flow passage 108 is formed between an exterior surface 110 of valve housing 92 and interior surface 104 of outer housing 76. In the exemplary embodiment, flow passage 108 includes an axial groove 112 formed in valve housing 92. Axially inward flow passage 108 is positioned circumferentially adjacent to at least one fuel delivery passage 114, and may be positioned circumferentially adjacent to two fuel delivery passages 114. Transverse flow passage 96 is positioned a spaced circumferential distance from two axially extending fuel delivery passages 114. Thus, transverse flow passage 96 extends between two adjacent fuel delivery passages 114, as best seen in FIG. 8. First drain passage 98 is positioned to connect injector cavity 80 to valve cavity 96.

Injection control valve assembly 24 also includes a seat portion 154, a seat retainer 156, and an adjusting ring 158 positioned in a distal end of valve cavity 94. Seat portion 154 includes a control valve seat 160 and a longitudinally extending seat portion passage 162. Adjusting ring 158 includes a plurality of radially or transversely extending adjusting ring passages 164. An annular groove 166 may be formed between an exterior of adjusting ring 158 and an interior surface of valve housing 92. In the exemplary embodiment, annular groove 166 is formed on an exterior of adjusting ring 158. Adjusting ring 158 is sized, positioned, and adjusted to space armature 136 an axial distance from stator 146 along control valve longitudinal axis 23.

As best seen in FIG. 8, injection control valve assembly 24 may also include a cover plate 168, which includes openings 170, and retainers 172. Retainers 172 include threads 174 formed at a first or distal end of retainers 172, an interface portion 176, and a pin portion 178. Valve housing 92 includes a plurality of threaded recesses 180 having threads that mate with threads 174. The first or distal end of retainers 172 extend through openings 170 formed in cover plate 168 to engage with threaded recesses 180. Interface portion 176 is shaped to mate with an adjusting tool (not shown) that permits retainers 168 to be tightened securely to valve housing 92. Once cover plate 168 is secured to valve housing 92 by retainers 172, the components positioned in valve cavity 94, including control valve member 26, actuator 28, seat portion 154, seat retainer 156, and adjusting ring 158, are secured within valve housing 92 to form a self-contained valve cartridge assembly 182. Valve cartridge assembly 182 may include a contact spring 184 positioned between stator housing 140 and cover plate 168 to position the fixed elements of valve cartridge assembly 182 in an abutting relationship when cover plate 168 is secured to valve housing 92. Because injection control valve cartridge assembly 182 is formed as a single integrated unit or a complete assembly, it may be easily installed or inserted within outer housing 76. Barrel portion 70 contains recesses (not shown) that mate with pin portion 178 to provide proper orientation of barrel portion 70 with cartridge assembly 182.

Barrel portion 70 is secured to outer housing 76 to hold nozzle housing 72, control valve assembly 24, and barrel portion 70 in compressive abutment. A set of mating threads 196 formed on an exterior of barrel portion 70 and an interior of outer housing 76 may establish the compressive abutment.

Drain circuit 90 extends from control volume 88 through injection control valve assembly 24, through outer housing 76 into mounting bore 36, to engine drain passage 86 of low-pressure engine drain circuit 84. More specifically, drain circuit 90 includes central passage 132, end portion passage 126, first drain passage 98, seat portion passage 162, valve cavity 94, adjusting ring passage 164, annular groove 166, transverse flow passage 96, axially inward flow passage 108, outlet port 102, and axially inwardly extending drain passage 186.

When injector control valve 134 is energized by an engine control system (not shown), actuator 28 is operable to move armature 136 longitudinally toward stator 146. Movement of armature 136 causes control valve member 26 to move longitudinally away from control valve seat 160, which causes drain circuit 90 to be connected with control volume 88. Fuel is immediately able to flow outwardly through central passage 132, end portion passage 126, first drain passage 98, and seat portion passage 162. Fuel then flows between control valve member 26 and control valve seat 160 and into valve cavity 94. The fuel in valve cavity 94 continues to flow longitudinally outward toward and then transversely through adjusting ring passage 164. Because adjusting ring 158 is movable to establish the position of stator housing 140, adjusting ring passage 164 may be misaligned with transverse flow passage 96. Annular groove 166 permits fuel to flow from adjusting ring passage 164 to transverse flow passage 96, regardless of the position of adjusting ring passages 164 with respect to transverse flow passage 96. Transverse flow passage 96 is in fluid communication with valve cavity 94 at an upstream or first end and axially inward flow passage 108, and thus engine drain passage 86 of low-pressure engine drain circuit 84, at a downstream or second end, receiving fuel flow from valve cavity 94 by way of adjusting ring passage 164. The fuel flows radially or transversely through adjusting ring passage 164, into annular groove 166, and into transversely extending passage 96, moving from valve cavity 96 into axially inward flow passage 108.

Once in axially inward flow passage 108, fuel flows longitudinally or axially inwardly in a direction that is toward outlet port 102, where the fuel flows into outlet port 102. Axially inwardly extending drain passage 186 receives the drain fuel from outlet port 102, directing the drain fuel longitudinally or axially inwardly in a direction that is toward the distal end of fuel injector 18, which is toward injector orifices 74. The fuel then flows into engine drain passage 86 of low-pressure engine drain circuit 84. Thus, drain circuit 90 is positioned to receive drain fuel from control volume 88 and to drain the fuel toward low-pressure engine drain circuit 84.

With connection of control volume 88 to engine drain circuit 84, fuel pressure in control volume 88 is significantly reduced in comparison to fuel pressure in injector cavity 80. The pressure on the distal end of nozzle valve element 82 is significantly greater than the pressure on the proximate end of nozzle valve element 82, forcing nozzle valve element 82 longitudinally away from injector orifices 74, and permitting high-pressure fuel to flow from injector cavity 80 into combustion chamber 42. When actuator 28 is de-energized, control valve member 26 is biased by valve bias spring 30 to cause injector control valve 24 to close. When injector control valve 24 is closed, pressure builds in control volume 88, causing, in combination with a nozzle element bias spring 188, nozzle valve element 82 to move longitudinally toward injector orifices 74, closing or blocking injector orifices 74.

Valve bias spring 30 is positioned to apply a bias force against control valve member 26, which determines how quickly control valve member 26 moves when solenoid assembly 138 is energized. Variations in solenoids and springs may lead to undesirable opening characteristics of control valve member 26, requiring an adjustment in the preload or compression force on valve bias spring 30. The force provided by valve bias spring 30 is adjusted by the position of spring preload adjustment device 32. The challenge presented by fuel injector 18 is the position of barrel portion 70, which includes an accumulator chamber 190 positioned along fuel delivery circuit 78. To set the position of preload adjustment device 32, fuel injector 18 must have high-pressure fuel flowing through accumulator chamber 190, which means that fuel injector 18 must be assembled prior to setting the position of preload adjustment device 32, making access to preload adjustment device 32 difficult.

Referring to FIGS. 4-11, preload adjustment device 32 in accordance with an embodiment of the present disclosure is shown. In the exemplary embodiment, access passage 34 is formed entirely in barrel portion 70 and includes an access passage axis 192 oriented at an acute angle 194 with respect to control valve longitudinal axis 23. Access passage 34 includes a first access passage or proximal end opening 200 formed on an exterior or outer side surface 202 of barrel portion 70, and thus injector body 20, and a second access passage or distal end opening 204 formed at a distal end 206 of barrel portion 70. Outer surface 202 of barrel portion 70 may be annular. When barrel portion 70 is secured in fuel injector 18, second access passage opening 204 is longitudinally adjacent to spring preload adjustment device 32 along control valve longitudinal axis 23. Access passage 34 is sized and positioned to receive an adjustment tool 198 to extend through first access passage opening 200, into access passage 34, and through second access passage opening 204 to reach a head portion of spring preload adjustment device 32 to permit adjustment of the preload force on valve bias spring 30.

As described hereinabove, fuel injector 18 includes cover plate 168. Cover plate 168 includes a central opening 208 that permits access to the head portion of spring preload adjustment device 32. In the exemplary embodiment, the head portion of spring preload adjustment device 32 extends into central opening 208.

Acute angle 194 must be sufficiently small to permit first access passage or proximal end opening 200 to be positioned a spaced longitudinal distance from outer housing 76 toward the proximate end of injector body 20. For example, acute angle 194 may be in the range 10 degrees to 35 degrees. Acute angle 194 may be more preferably in the range 17 degrees to 30 degrees. In the exemplary embodiment, acute angle 194 is about 22 degrees. Because acute angle 194 is greater than zero degrees, access passage 34 extends transversely to control valve longitudinal axis 23 toward annular outer surface 202 of barrel portion 70. The result of acute angle 194 is that proximal end opening 200 is in an axial position along control valve longitudinal axis 23 that is between spring preload adjustment device 32 and a proximate or proximal end 244 of injector body 20 of fuel injector 18. This position permits accumulator chamber 190 to be positioned along control valve longitudinal axis 23, which is also the axis of spring preload adjustment device 32, in a location that is between spring preload adjustment device 32 and proximate end 244 of injector body 20. In the exemplary embodiment, proximal end opening 200 is in a longitudinal position that is between outer housing 76 and fuel injector proximate end 244. Furthermore, a proximate or proximal end 248 of outer housing 76 is positioned in a location that is longitudinally between spring preload adjustment device 32 and proximal end opening 200 of access passage 34.

Figure 3:
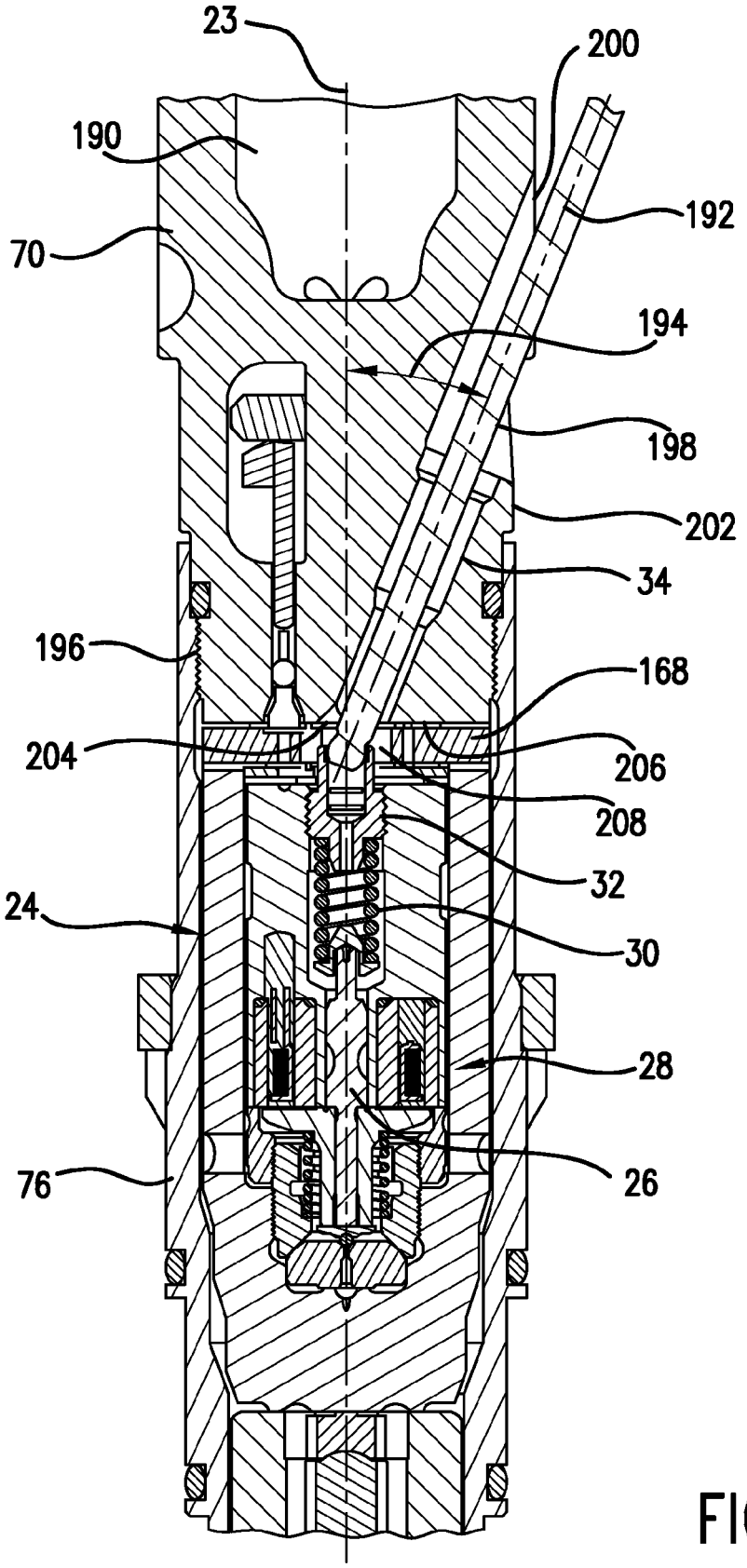
FIG. 3 is a cross-sectional view of a portion of a fuel injector of the internal combustion engine of FIG. 2 along the lines 3-3, as though the portion of FIG. 2 were whole.
Figure 4:
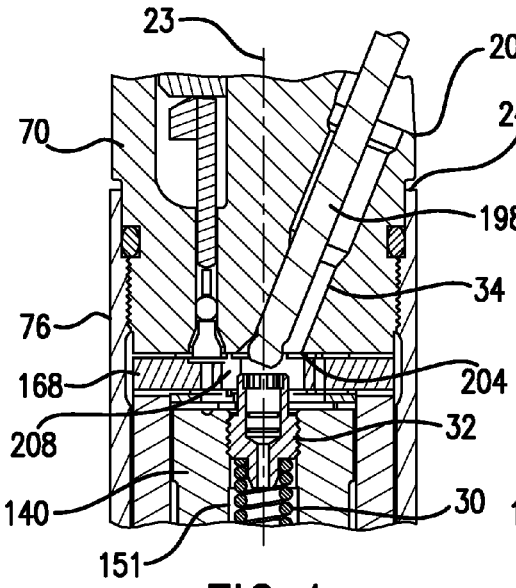
FIG. 4 is a cross-sectional view of a portion of the fuel injector of FIG. 3, showing insertion of an adjustment tool into the fuel injector.

Access passage axis 192 is positioned a spaced transverse distance from control valve longitudinal axis 23 where access passage axis 192 exits barrel portion distal end 206. Access passage axis 192 intersects control valve longitudinal axis 23 at a spaced distance along control valve longitudinal axis 23 away from barrel portion distal end 206 and toward the distal end of fuel injector 18. The intersection of access passage axis 192 with control valve longitudinal axis 23 is spaced away from barrel portion distal end 206 because spring preload adjustment device 32 is positioned along control valve longitudinal axis 23 in the plane shown in FIG. 3. Thus, in order for tool 198 to enter the head portion of spring preload adjustment device 32, the head portion of spring preload adjustment device 32 is at a spaced distance that is longitudinally separated from barrel portion distal end 206, as best seen in FIG. 4.

Figure 5:
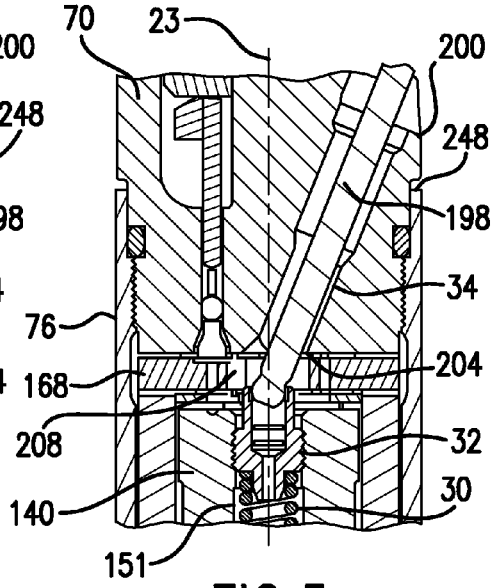
FIG. 5 is a cross-sectional view similar to FIG. 4, showing the adjustment tool at a position that provides a maximum preload force to a bias spring of an injection control valve of the fuel injector.
Figure 6:
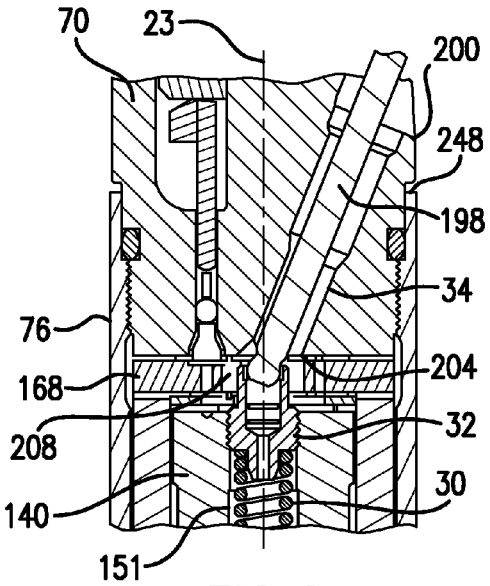
FIG. 6 is a cross-sectional view similar to FIG. 4, showing the adjustment tool at a position that provides a minimum preload force to the bias spring of the injection control valve of the fuel injector.
Figure 7:
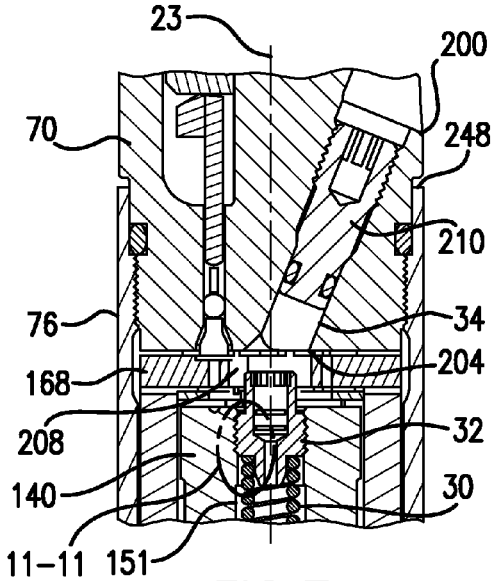
FIG. 7 is a cross-sectional view similar to FIG. 4, showing an adjusted injection control valve with a plug positioned in an access port of the fuel injector.

Once adjustment tool 198 engages the head portion of spring preload adjustment device 32, the position of spring preload adjustment device 32 may be changed by rotation of spring preload adjustment device 32 about its axis. As shown in FIG. 5, spring preload adjustment device 32 may be adjusted along control valve longitudinal axis 23 in a first direction toward the distal end of fuel injector 18, which increases the preload or compression force on valve bias spring 30 to a maximum. As shown in FIG. 6, spring preload adjustment device 32 may be adjusted along control valve longitudinal axis 23 in a second direction toward the proximate end of fuel injector 18, which reduces the preload or compression force on valve bias spring 30 to a minimum. Once spring preload adjustment device 32 has been adjusted to establish the fuel injection characteristics of fuel injector 18, tool 198 is retracted or removed from access passage 34. In order to limit access to spring preload adjustment device 32 to prevent tampering with spring preload adjustment device 32 and to prevent inadvertent or undesired fuel leakage from access passage 34, a sealed plug 210 may be inserted into access passage 34.

Figure 9:
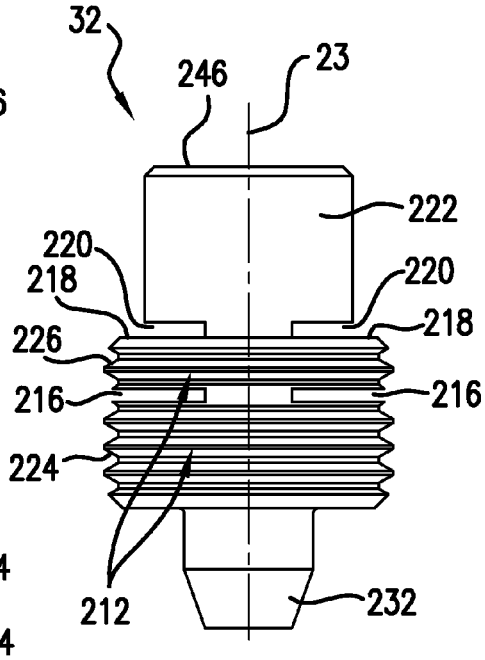
FIG. 9 is an elevation view of an adjustment device of the injection control valve of the fuel injector of FIG. 2.
Figure 10:
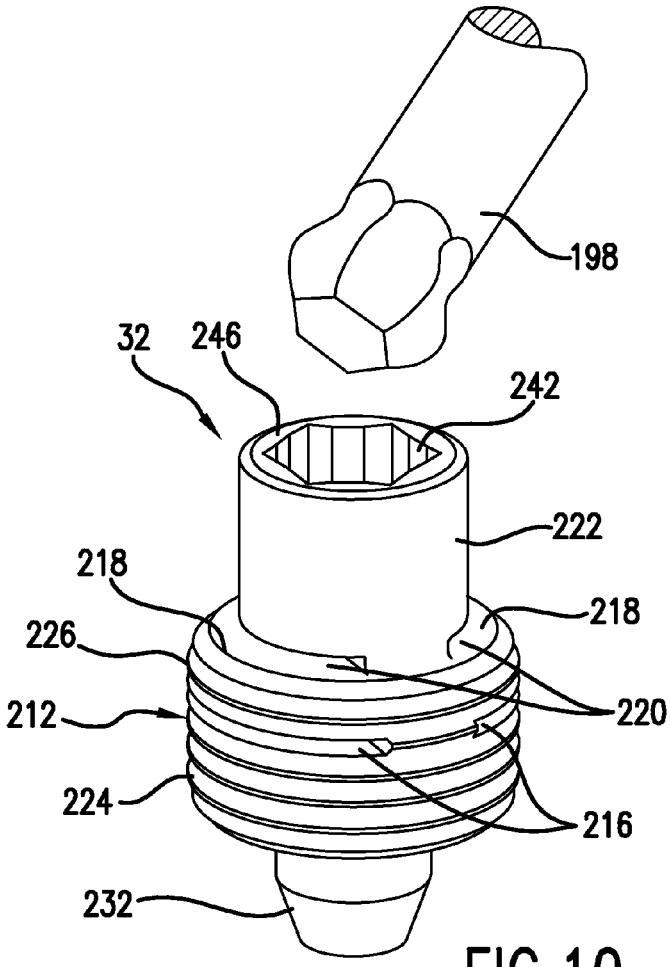
FIG. 10 is a perspective view of the adjustment device of FIG. 9, including an end of an adjustment tool.
Figure 11:
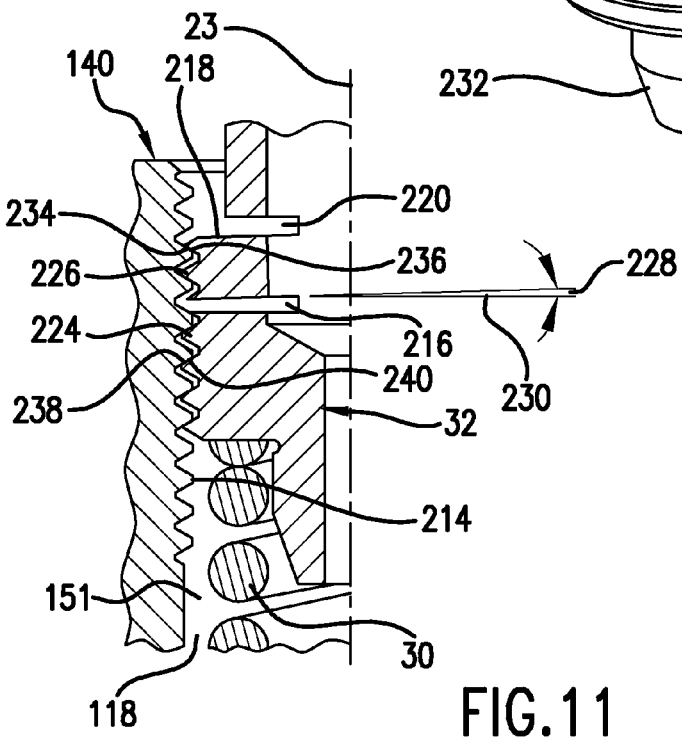
FIG. 11 is a detailed sectional view of a portion of the adjustment device along the lines 11-11 in FIG. 7.

Fuel injector 18 is subject to significant vibrations during operation. These vibrations have the potential to cause spring preload adjustment device 32 to move, which would affect the fuel delivered by fuel injector 18. In order to prevent spring preload adjustment device 32 from moving, spring preload adjustment device 32 includes features to secure spring preload adjustment device 32 in spring bore portion 151. Referring to FIGS. 9-11, stator housing 140, and more specifically, spring bore portion 151, includes internal threads 214, and spring preload adjustment device 32 includes an external thread 212 adapted to engage internal threads. A material, often called thread-lock or thread-locker, may be applied to external threads 212 to resist movement of spring preload adjustment device 32. However, such material may flake from external threads 212, risking contamination of fuel injector 18, which is sensitive to such contamination. Another undesirable characteristic of the thread-lock material is that it results in a thin layer of the thread-lock material between internal threads 214 of stator housing 140 and external threads 212 of the spring preload adjustment device 32. The thickness of this thin layer of thread-lock material can change over time due to the load that the threads carry and the typical creep characteristics of the thread-lock material. This change in thickness, in turn, results in an unintended and undesirable axial movement of spring preload adjustment device 32.

To provide for a mechanical thread-locking feature, spring preload adjustment device 32 includes at least one first slot 216 oriented at approximately 90 degrees to control valve longitudinal axis 23. Spring preload adjustment device 32 may include a pair of first slots 216 positioned on opposite sides of spring preload adjustment device 32. Spring preload adjustment device 32 further includes at least one cantilevered portion 218, a head portion 222 having a proximal end face or surface 246, a tip portion 232, and one or more second slots 220 positioned longitudinally a spaced distance from first slots 216. First slots 216 divide external adjustment device threads 212 into a first set of threads 224 and a second set of threads 226. Each cantilevered portion 218 is mechanically deformed in a longitudinal direction to change the longitudinal distance between first set of threads 224 and second set of threads 226, creating a deformation angle 228 from a plane 230 that is perpendicular to control valve axis 23. Proximal end face or surface 246 is positioned at the proximate end of spring preload adjustment device 32 and extends transversely to control valve longitudinal axis 23. Proximal end face 246 includes a tool engagement feature or receiving portion 242 sized to receive tool 198. In the exemplary embodiment, tool engagement feature 242 is an internal hex. Tip portion 232 extends along longitudinal axis 23 into a central portion of valve bias spring 30.

The direction of the deformation of cantilevered portion 218 is preferably toward tip portion 232 away from head portion 222 or in the direction of first set of threads 224. The amount of the deformation of cantilevered portion 218 before the first installation is preferably less than one-half the thread pitch, but sufficiently large enough to assure first set of threads 224 and second set of threads 226 interfere or mechanically resist movement against internal threads 214 of stator housing 140. The amount of deformation affects the torque required to drive spring preload adjustment device 32, so excessive deformation is undesirable as well. Approximate deformation before the first installation in the range 10% to 40% of the thread pitch assures that second set of threads 226 in cantilevered screw portion 218 contact screw threads 214 in stator housing 140 and first set of threads 224 contact screw threads 214 in stator housing 140, thus resisting movement of spring preload adjustment device 32 after installation.

As shown in FIG. 11, a lower portion 234 of second set of threads 226 in cantilevered screw portion 218 contacts an upper portion 236 of stator housing internal threads 214. Because of the action of spring preload adjustment device 32, first set of threads 224 are pulled to the opposite side of stator housing internal threads 214 as compared to second set of threads 226 in cantilevered portion 218. Thus, an upper portion 238 of first set of threads 224 contacts lower portion 240 of stator housing internal threads 214. As previously noted the contact between the aforementioned threads causes resistance to movement of spring preload adjustment device 32. Because of the deformation of cantilevered portion 218, first set of threads 224 and second set of threads 226 form a mechanical locking thread.

The transverse width of first slots 216 should be sufficient to permit deformation of cantilevered portion 218 while retaining sufficient strength to retain structural integrity during installation of spring preload adjustment device 32. The transverse width of first slots 216 needs to be sufficient to permit the needed deformation, which will vary with thread pitch. Each first slot 216 may be approximately 25% of the diameter of spring preload adjustment device 32 to 40% of the diameter of spring preload adjustment device 32, depending on the material of screw 40. The purpose of second slots 220 is to permit cantilevered portion 218 to move with respect to head portion 222. The transverse width of second slots 220 is preferably at least the transverse width of first slots 216.

One suitable material for spring preload adjustment device 32 may be ASTM 4140H. If spring preload adjustment device 32 has a nominal thread pitch diameter of 8.5 mm, then each first slot 216 may extend 3 mm into spring preload adjustment device 32 as measured from the outside maximum diameter of adjustment device threads 212, which is approximately 35% of the overall diameter of spring preload adjustment device 32. The longitudinal height of each first slot 216 may be 0.4 mm. The dimensions of second slots 220 may be similar to first slots 216.

While this discussion has described two first slots 216, one first slot 216, and thus one cantilevered portion 218, may provide sufficient preload or resistance to prevent movement of spring preload adjustment device 32. In addition, second set of threads 226 is deformed toward tip portion 232 for ease of manufacturing. However, second set of threads 226 may also be deformed away from screw tip portion 212. Adjustment devices threads 212 need some flexibility to deform without damage, thus spring preload adjustment device 32 should not be through hardened. The material of spring preload adjustment device 32 needs to have a sufficient yield strength to permit elastic deformation of adjustment devices threads 212 to permit cantilevered screw portion 218 to act as a "spring" to maintain the position of spring preload adjustment device 32 after installation.

While various embodiments of the disclosure have been shown and described, it is understood that these embodiments are not limited thereto. The embodiments may be changed, modified and further applied by those skilled in the art. Therefore, these embodiments are not limited to the detail shown and described previously, but also include all such changes and modifications.

We claim:

1. A fuel injector for injecting fuel at high pressure into a combustion chamber of an internal combustion engine, comprising:

an injector body including a longitudinal axis, a barrel portion, a nozzle housing, a side surface, a fuel delivery circuit, and an injector orifice formed in the nozzle housing to discharge fuel from the fuel delivery circuit into the combustion chamber;

an injection control valve assembly positioned along the longitudinal axis between the barrel portion and the nozzle housing, the injection control valve assembly including a control valve member adapted to move between a first position and a second position and an actuator adapted to cause movement of the control valve member between the first and the second positions, the actuator including a bias spring positioned to apply a bias force to the control valve member, and a spring preload adjustment device positioned adjacent one end of the bias spring to apply a preload force to the bias spring, the spring preload adjustment device including a proximal end face extending transversely to the longitudinal axis and a tool engagement feature formed in the proximal end face; and an access passage formed in the barrel portion and extending transversely to the longitudinal axis, the access passage including a proximal end opening at the side surface of the injector body and a distal end opening positioned adjacent the tool engagement feature at the proximal end face of the spring preload adjustment device, the access passage sized and positioned to receive a tool to engage the spring preload adjustment device to adjust the preload force on the bias spring.

2. The injector of claim 1, wherein the access passage is formed entirely in the barrel portion.

3. The injector of claim 1, further including an outer housing connected to the barrel portion to hold the barrel portion, injection control valve assembly, and nozzle housing in compressive abutment.

4. The injector of claim 3, wherein the outer housing includes a proximal end positioned longitudinally between the spring preload adjustment device and the proximal end opening of the access passage.

5. The injector of claim 1, further including a nozzle valve element positioned in the nozzle housing adjacent the injector orifice, the nozzle valve element movable between an open position in which fuel may flow through the injector orifice into the combustion chamber and a closed position in which fuel flow through the injector orifice is blocked, the injector further including a control volume positioned adjacent the nozzle valve element to receive a pressurized supply of fuel from the fuel delivery circuit, and a drain circuit positioned to drain fuel from the control volume toward a low pressure drain; the first position of the control valve member blocking flow through the drain circuit and the second position permitting flow through the drain circuit, the bias force biasing the control valve member toward the first position.

6. The injector of claim 1, wherein the actuator includes a solenoid assembly including a stator, a coil positioned around the stator, and an armature operably connected to the control valve member.

7. The injector of claim 1, wherein the tool engagement feature includes a recess sized to receive the tool.

8. The injector of claim 1, wherein the injection control valve assembly further includes a housing, a spring bore formed in the housing, and internal threads formed in the housing within the spring bore, the spring preload adjustment device including external threads adapted to engage the internal threads.

9. The injector of claim 1, wherein the spring preload adjustment device includes at least one slot extending along a plane transversely to the longitudinal axis through the external threads to form a first set of threads and a first cantilevered portion having a second set of threads, the first cantilevered portion deformed to extend along a first deformation angle from a plane perpendicular to the longitudinal axis.

10. The injector of claim 1, wherein the first cantilevered portion is deformed longitudinally toward the first set of threads.

11. The injector of claim 10, wherein the at least one slot includes a first slot and a second slot formed on opposite sides of the spring preload adjustment device, the spring preload adjustment device further including a second cantilevered portion positioned adjacent the second slot and deformed to extend along a second deformation angle from a plane perpendicular to the longitudinal axis.

12. A fuel injector for injecting fuel at high pressure into a combustion chamber of an internal combustion engine, comprising:

an injector body including a longitudinal axis, a proximal end, a distal end, an outer annular side surface, an outer housing, an accumulator, a fuel delivery circuit, and an injector orifice positioned at the distal end to discharge fuel from the fuel delivery circuit into the combustion chamber; and an injection control valve assembly positioned along the longitudinal axis between the proximal end and the distal end, the injection control valve assembly including a control valve member adapted to move between a first position and a second position and an actuator adapted to cause movement of the control valve member between the first and the second positions, the actuator including a bias spring positioned to apply a bias force to the control valve member, and a spring preload adjustment device positioned adjacent one end of the bias spring to apply a preload to the bias spring; the spring preload adjustment device including at least one slot extending along a plane transversely to the longitudinal axis through the external threads to form a first set of threads and a first cantilevered portion having a second set of threads, the first cantilevered portion deformed to extend along a first deformation angle from a plane perpendicular to the longitudinal axis.

13. The injector of claim 12, further including an access passage formed in the injector body and extending transversely to the longitudinal axis, the access passage including a proximal end opening positioned at the outer annular side surface of the injector body and a distal end opening adjacent the spring preload adjustment device, the access passage sized and positioned to receive a tool to engage the spring preload adjustment device to adjust the preload force on the bias spring.

14. The injector of claim 12, further including an outer housing and wherein the outer housing includes a proximal end positioned longitudinally between the spring preload adjustment device and the proximal end opening of the access passage.

15. The injector of claim 12, wherein the actuator includes a solenoid assembly including a stator, a coil positioned around the stator, and an armature operably connected to the control valve member.

16. The injector of claim 12, wherein the first cantilevered portion is deformed longitudinally toward the first set of threads.

17. The injector of claim 12, wherein the at least one slot includes a first slot and a second slot formed on opposite sides of the spring preload adjustment device, the spring preload adjustment device further including a second cantilevered portion positioned adjacent the second slot and deformed to extend along a second deformation angle from a plane perpendicular to the longitudinal axis.

* * * * *